US006932638B1

(12) United States Patent
Burrows et al.

(10) Patent No.: US 6,932,638 B1
(45) Date of Patent: Aug. 23, 2005

(54) TAP HANDLE WITH AN INTEGRAL ELECTRICAL CONNECTION

(75) Inventors: Christian P. Burrows, Tacoma, WA (US); Paul D. Fichter, Tukwilla, WA (US)

(73) Assignee: Taphandles Inc., Kent, WA (US)

( * ) Notice: Subject to any disclaimer, the term of this patent is extended or adjusted under 35 U.S.C. 154(b) by 0 days.

(21) Appl. No.: 10/820,166

(22) Filed: Apr. 6, 2004

(51) Int. Cl.[7] ..... H01R 13/627
(52) U.S. Cl. ..... 439/364; 439/21; 439/22
(58) Field of Search ..... 439/21, 22, 20, 439/364, 362; 137/607; 222/22, 25, 14, 146, 222/250; 340/815.2; 40/332

(56) References Cited

U.S. PATENT DOCUMENTS 2,669,483 A * 2/1954 Fletcher ..... 222/333
3,599,839 A * 8/1971 Hansen ..... 222/146.6
4,212,414 A * 7/1980 Beyens ..... 222/148
4,894,647 A * 1/1990 Walden et al. ..... 340/815.45
5,491,617 A * 2/1996 Currie ..... 362/96
5,586,691 A * 12/1996 Gotch et al. ..... 222/113
5,750,905 A * 5/1998 Weimer et al. ..... 73/863
6,029,699 A * 2/2000 Granot ..... 137/607
6,719,578 B1 * 4/2004 Klassen et al. ..... 439/289
6,739,578 B2 * 5/2004 Barton et al. ..... 251/149.9
6,786,361 B2 * 9/2004 Moothart et al. ..... 222/130

* cited by examiner

*Primary Examiner*—Alexander Gilman
(74) *Attorney, Agent, or Firm*—Stratton Ballew PLLC

(57) ABSTRACT

An integral electrical connection for use with a tap handle in a beverage dispenser. With the integral electrical connection, the tap handle can be internally suppled with low voltage power, with safety and reliability, by a quick connection circuit, housed within the tap handle. The tap handle is attachable to a standard tap valve or faucet, typically used in dispensing beverages, such as beer, to provide an efficient and standardized solution to the problem of managing power cords and wires to the tap handle, to power any element within the tap handle, typically for the purpose of internally lighting or illuminating the tap handle, typically a bulb or diode, such as a LED. The electrified tap includes a bushing receivable onto a locknut. A set of conductors ring the threaded tap. A lower pair of contacts are wired to a low voltage power source external to the tap. An upper pair of contacts within the handle touch the lower pair within the tap, when the handle is screwed onto the threaded tap stem. The contacts can be formed with alternative shapes, to better provide for the inner electrical contact, such as a wave pattern. Electrical contact is achieved without regard to the orientation of the upper contacts to the lower contacts, and so the electrified tap handle functions safely and reliably.

16 Claims, 7 Drawing Sheets

TAP HANDLE WITH AN INTEGRAL ELECTRICAL CONNECTION

TECHNICAL FIELD

The invention relates to an apparatus for an electrical connection that is especially effective for use with a tap handle in a beverage dispenser. With the electrical connection of the present invention, the tap handle can be internally suppled with low voltage power, with safety and reliability, by a quick connection circuit, housed within the tap handle.

BACKGROUND OF THE INVENTION

It is well known in the field of beverage dispensing systems, to supply the handle of a tap, valve, or faucet with electrical power, typically for the purpose of illuminating the handle. U.S. Pat. No. 5,491,617 to Currie shows a tap that employs fiber optic cables to illuminate portions of the tap and handle. The fiber optic cable runs externally to the tap and handle. Furthermore, no connections are suggested, nor disclosed, for bridging the tap and handle, especially a solution that also addresses the need for tap handles to have a proper orientation on the tap, as directed toward patrons. More generally, for quick disconnecting electrical connections, U.S. Pat. No. 3,043,925 to Wilson discloses a quick-release electrical connection that surrounds a threaded core. The connection of Wilson includes male and female clips that are cumbersome, but appear to be able to disengage when the connector is separated. U.S. Pat. No. 3,159,444 to Stine shows a breakaway electrical connection very similar to Wilson '295, but it is observed that both of these quick-release references require a near-perfect alignment to function. Even when combined, these prior patent references neither provide, nor suggest, a safe and reliable electrical connection between a handle and tap. A system is needed for a quick connection electrical circuit within the tap and tap handle, which also provides for orienting the tap handle in any desired direction about the tap. The present invention will be better understood by reference to the following detailed description taken in conjunction with the accompanying drawings.

DETAILED DESCRIPTION OF SPECIFIC EMBODIMENTS

A foremost purpose of the present invention provides a tap handle with an integral electrical connection. The tap handle is attachable to a standard tap valve or faucet, typically used in dispensing beverages, such as beer. A preferred embodiment of an integral electrical connection within a tap handle assembly, or an "electrified tap" 21, is shown in FIGS. 1 through 10. The electrified tap provides an efficient and standardized solution to the problem of managing power cords and wires to a tap handle 22, to provide a power source to the tap handle, typically for the purpose of internally illuminating the tap handle.

Figure 3:
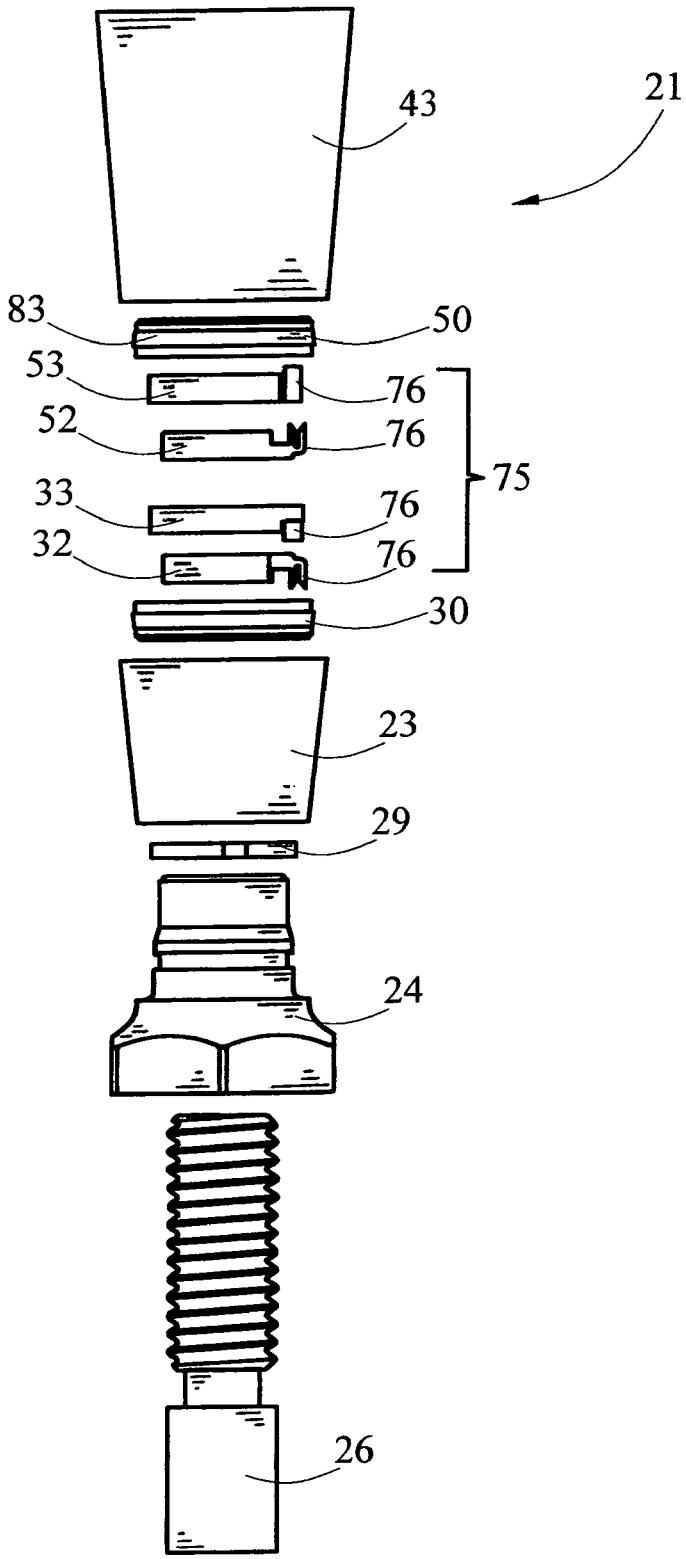
FIG. 3 is a partially exploded view of a tap handle with an integral electrical connection, according to an embodiment of the invention.
Figure 5:
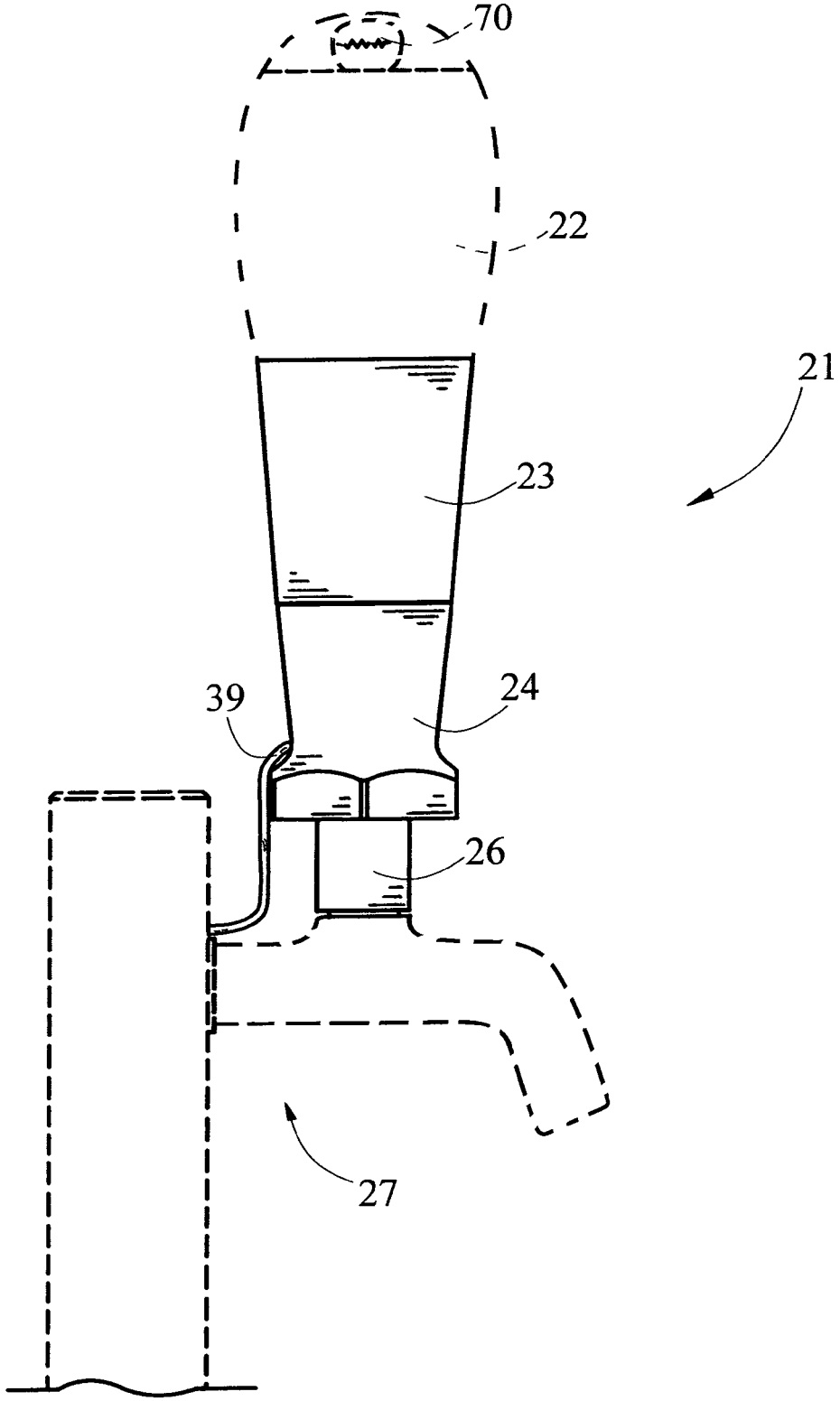
FIG. 5 is a side view of a tap handle with an integral electrical connection, according to an embodiment of the invention.

As shown in FIGS. 3 and 5, the electrified tap 21 includes a bushing 23, which is receivable onto a locknut 24. As preferred, the locknut is a conventional component of a tap handle assembly, built to be received onto a tap stem 26. As is typical, the action of the tap stem controls the flow of a beverage thorough a tap 27.

Figure 4:
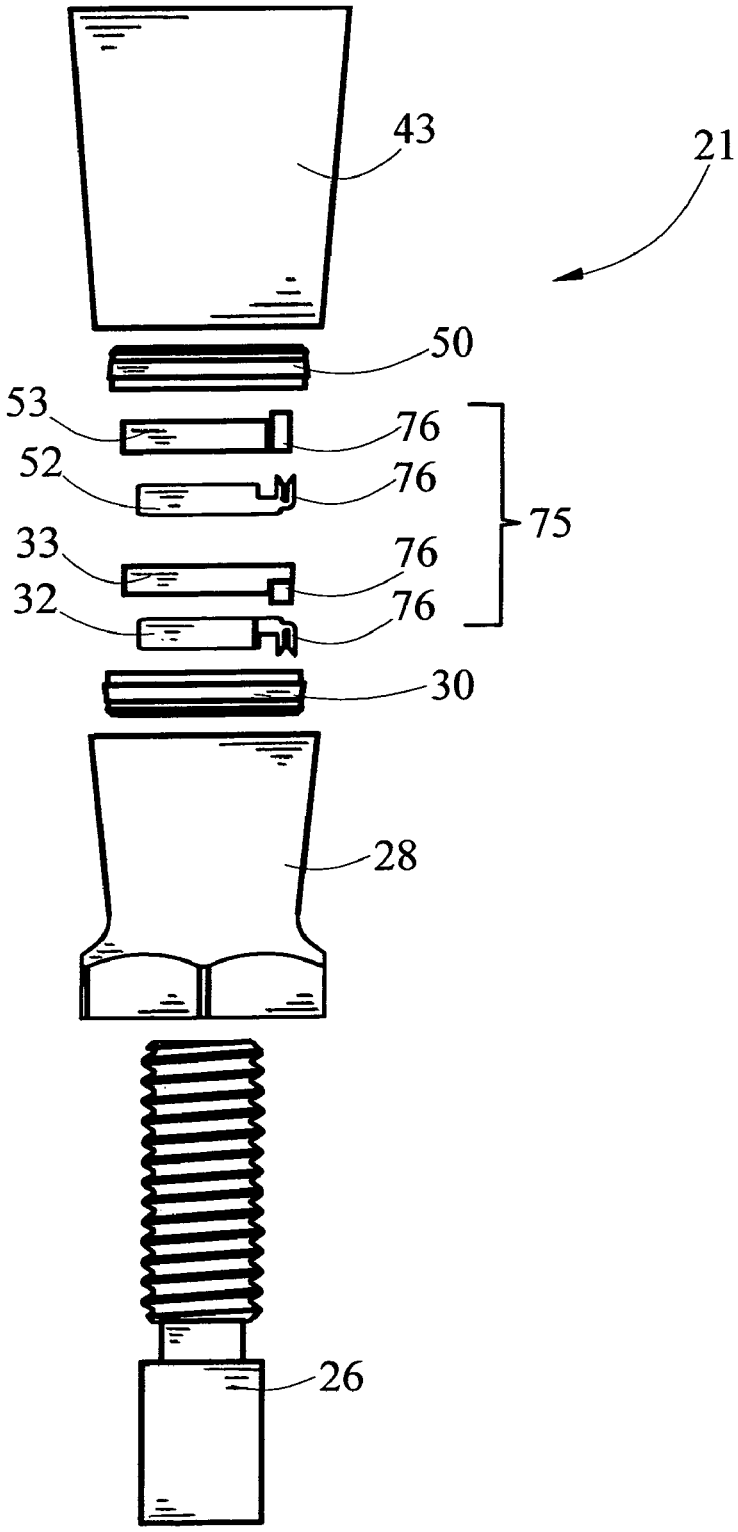
FIG. 4 is a partially exploded perspective view of a tap handle with an integral electrical connection, according to an embodiment of the invention.

In an alternative embodiment of the present invention, the bushing 23 and the locknut 24 may be combined into a unitized bushing and nut 28, as shown in FIG. 4. Also alternatively, and as most preferred, the locknut is manufactured specifically for use with the present invention and substituted for the standard locknut included with the tap 27, which in the alternative, may be any dispensing valve or faucet having a means of control similar to the tap handle 22, which can be conventionally referred to simply as a "handle."

As shown in FIG. 3, for a preferred embodiment of the present invention, a retaining ring 29 is preferably employed between the bushing and the lock nut, primarily to provide a "snap" assembly to hold the bushing and the locknut 24 together, allowing the bushing to remain stationary as the locknut rotates about the tap stem. The tap stem is typically a ⅜ inch diameter with a standard, male thread, typically 16 UNC (16 threads per inch, American Standard, Coarse Unified Thread Series, as defined under ANSI BI.I-1989), or a substantial equivalent. The locknut, or the unitized bushing and nut are most preferably female threaded ⅜, and 16 UNC, also. If desired, any non-standard or alternative threading, tap diameter, or nut diameter could be utilized with the present invention.

Figure 1:
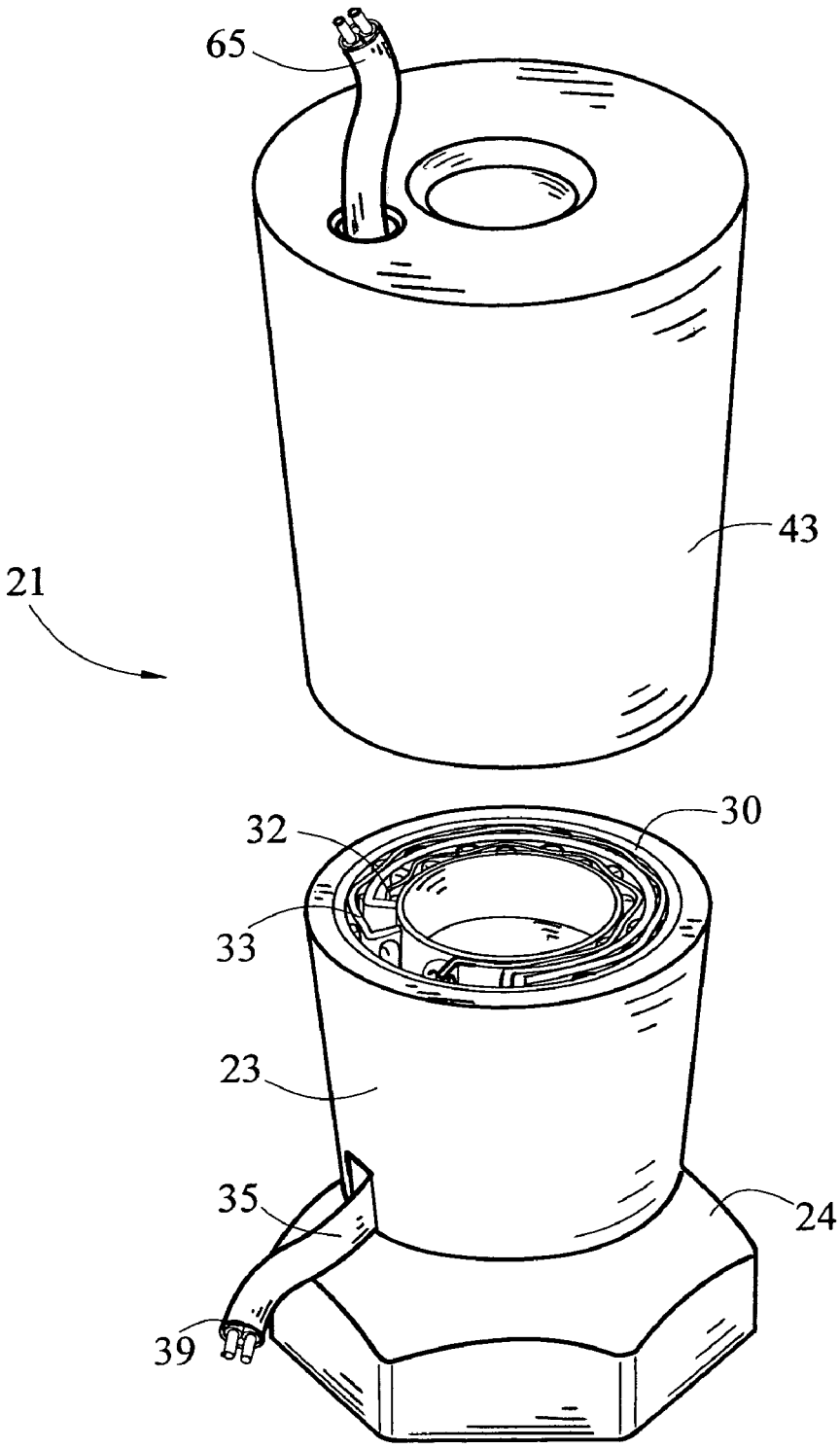
FIG. 1 is a perspective view of a tap handle with an integral electrical connection, according to an embodiment of the invention.

As shown in FIGS. 1 and 3, a lower contact core 30 is receivable within the bushing 23, or as shown in FIG. 4, the unitized bushing and nut 28, as an alternative. Hereinafter, whenever the locknut 24, or the bushing are referred to, it should be understood that the discussion also applied to the unitized bushing and nut. The lower contact core is detailed in FIGS. 1 and 7. The lower contact core includes a lower inner contact 32, and a lower outer contact 33. The lower inner contact is contained within the lower contact core in a concentric relation to the lower outer contact 32.

Figure 2:
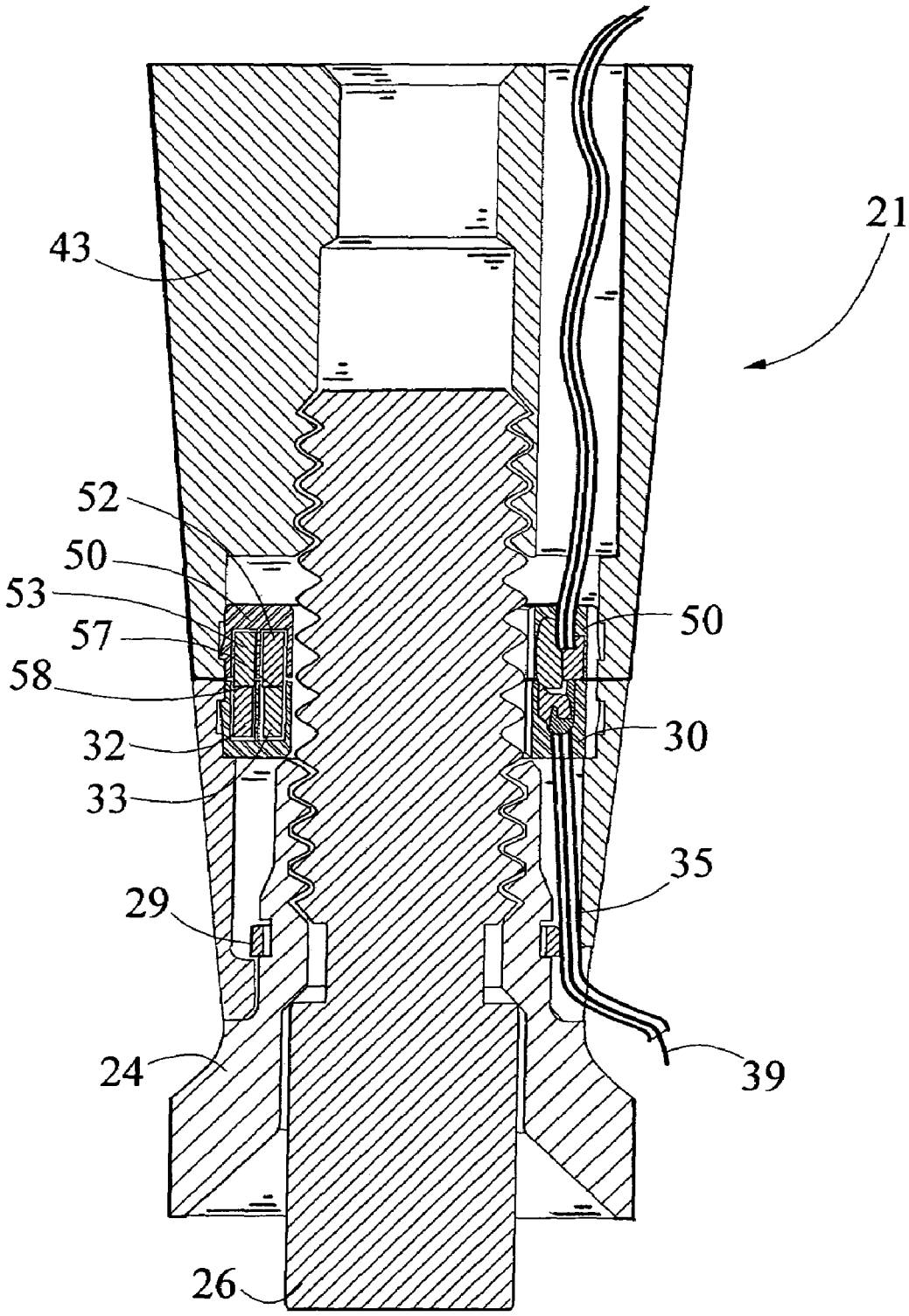
FIG. 2 is a sectioned view of a tap handle with an integral electrical connection, according to an embodiment of the invention.
Figure 7:
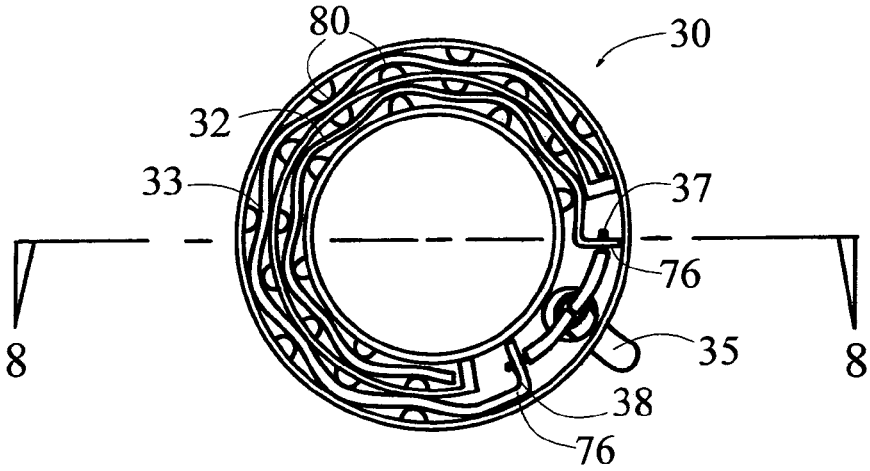
FIG. 7 is a plan view of a lower contact core of a tap handle with an integral electrical connection, according to an embodiment of the invention.

An electrical current is supplied to the lower contact core 30, as shown in FIGS. 1, 2, and 7. The electrical current supplied to the electrified tap 21 is embodied in a tap electrical conductor 35. The tap electrical conductor is most preferably, a two pole electrical connector with a first supply pole 37, and a second supply pole 38. The first supply pole connects to the lower inner contact 32 of the lower contact core 30, and the second supply pole connects to the lower outer contact 33.

In a preferred embodiment of the electrified tap 21, the tap electrical conductor 35 provides approximately, approximately 800 milliamperes (mA) of 12 volt (V) electrical power. Note that the term "approximately" is used herein to refer to a range of values, understood by a person skilled in the pertinent field or skill, as substantially equivalent to the herein stated values in achieving the desired results, in a range typical to the selection, accuracy, or precision of conventional tooling, measurement, or manufacturing. Alternative voltages or amperages could easily be utilized in the present invention. 12V is selected as a typical direct current power supply, easily transformed from standard 110V alternating current and at low amperage, and not considered a hazard in the event of inadvertent shock. The preferred amperage "draw" or "load" of the electrified tap is dictated by the power supply needs of the electrified tap. For most purposes, less than one ampere of low voltage power is sufficient to adequately illuminate the tap handle 22, attached to the electrified tap.

For the tap electrical power conductor 35, the first supply pole 37 and a second supply pole 38 is a wire pair 39, as shown in FIG. 1. The wire pair may be any conventional, two conductor wire, of sufficient gauge to provide for the transmission of the low amperage needed for the electrical tap 21, at a sufficiently low resistance. As an alternative to the wire pair, a pair of flat wire ribbons, or some similar pairing of electrical conductors, known to those skilled in the field of low voltage wiring, could be employed. A "keyway" as is known by those skilled in milling technologies, could be employed instead of the routing the tap electrical power conductor through the bushing. Additionally, such a keyway could be employed to hide the power conductor within the locknut. A multiples of such a keyway could be milled into the locknut to provide several optional placements of the tap electrical power conductor.

As shown in FIG. 2, the bushing 23 rotates freely in relation to the locknut 24. The locknut performs the function of tightening the individual components of the electrified tap 21 together. The bushing can therefore maintain a particular orientation, allowing the tap electrical power conductor 35, or wire, likewise to maintain the desired direction. This feature provides for the hiding of the power conductor, behind the electrified tap, if desired. Preferably, as also shown in FIG. 2, the bushing clasps the locknut by the conventional "snap" assembly, utilizing the retaining ring 29, to allow the bushing and locknut to rotate in relation to each other about the tap stem 26. The assembly of the bushing, retaining ring and the locknut, together serve as a conventional locknut, as found in non-powered, or otherwise conventional taps handles.

A ferule 43 is threadingly receivable onto the tap stem 26. The ferrule is received onto the tap stem, and abuts to the bushing 23, as shown in FIG. 2. Similar to the locknut 24, the ferrule includes a central ferrule opening 44 having a female thread within. Most preferably, this ferrule opening is approximately ⅜ of an inch in diameter, and tapped with a 16 UNC thread to receive the tap stem. Again, as with the locknut, any non-standard or alternative threading, tap diameter, or ferrule opening diameter could be utilized with the ferrule of the present invention, if desired.

Figure 6:
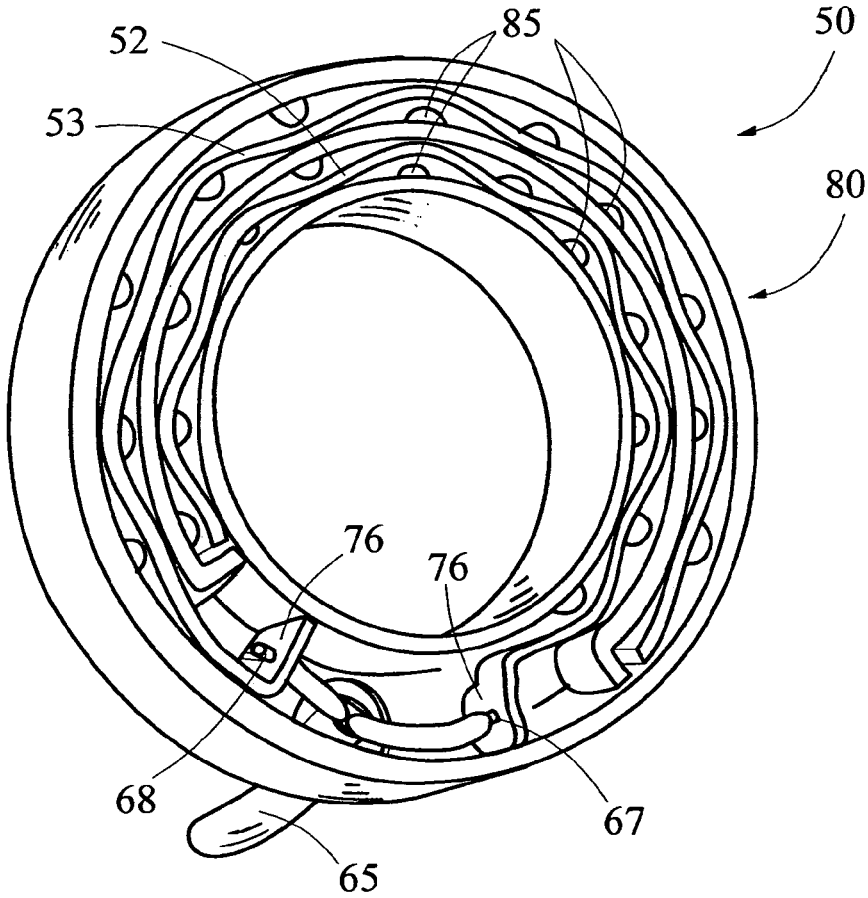
FIG. 6 is a perspective view of an upper contact core of a tap handle with an integral electrical connection, according to an embodiment of the invention.

For a preferred embodiment of the present invention, the ferrule 43 includes an upper contact core 50 that is receivable within the ferule. Similar to the lower contact core 30 of the bushing 23. As shown in FIG. 6, the upper contact core includes an upper inner contact 52 and an upper outer contact 53. The upper inner contact is contained within the upper contact core in a concentric relation to the upper outer contact 52. The upper and lower contact cores can include ridges around their perimeters, to snap into place within the ferrule or bushing, respectively. Also alternatively, the contact core may be glued, screwed or somehow mounted in place, as would be achieved by a person skilled in such assembly practices.

Figure 10:
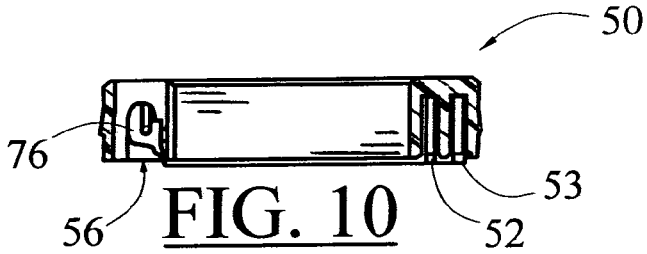
FIG. 10 is a section view of an upper contact core of a tap handle with an integral electrical connection, taken along section line 10—10 of FIG. 9, according to an embodiment of the invention.
Figure 8:
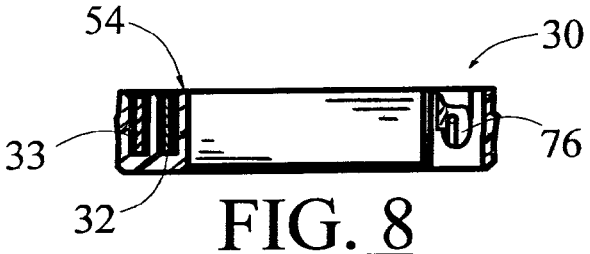
FIG. 8 is a section view of a lower contact core of a tap handle with an integral electrical connection, taken along section line 8—8 of FIG. 7, according to an embodiment of the invention.

As shown in FIGS. 2, 8 and 10, the lower contact core 30 has a lower contact face 54, and the upper contact core 50 has an upper contact face 56. When the upper contact face of the upper contact core meets against the lower contact face of the lower contact core, as shown in FIG. 2, the upper contact core is energized by the electrical current. Specifically, when the upper contact core touches the lower contact core, an inner electrical contact 57 forms between the lower inner contact 32 and the upper inner contact 52, and an outer electrical contact 58 forms between the lower outer contact 33 and the upper inner contact 53.

Figure 9:
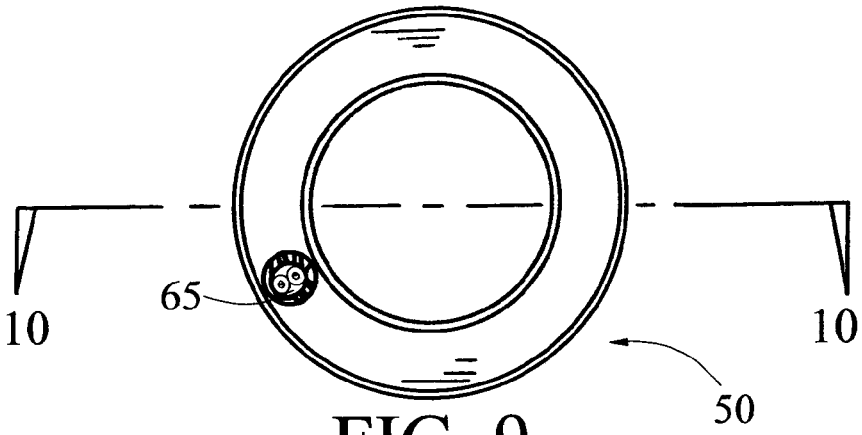
FIG. 9 is a plan view of an upper contact core of a tap handle with an integral electrical connection, according to an embodiment of the invention.

When viewed from the side, or in profile, as shown in FIG. 8, for the lower contact core 30, the lower inner contact 32 and the lower outer contact 33, are both approximately "flush" or even across the lower contact face 54. Similarly, as shown in FIG. 9, for the upper contact core 50, the upper inner contact 52 and the upper outer contact 53, are both approximately flush across the upper contact face 56.

For a most preferred embodiment of the electrified tap 21 of the present invention, the inner electrical contact 57, and the outer electrical contact 58 are achieved without regard to the orientation of the upper contact core 50 relative to the lower contact core 30, about the tap stem 26. And so, the tap handle 22 functions, energized, or is electrified, regardless of the orientation of the ferule 43 to the bushing 23 about the tap stem. Conventional tap handles are installed by first lowering the locknut 24 onto the tap stem completely, then manually twisting or screwing the tap handle onto the tap stem until it meets against the locknut. Once the tap handle and locknut meet, the tap handle is reverse twisted away from the lock nut, until the tap handle faces the desired direction. The locknut is then screwed in the reverse direction of rotation, up the tap stem and toward the handle, tightening the locknut against the tap handle. This action serves to maintain the tap handle locked in the correct and desired position. The electrified tap of the present invention is installed with a similar operation. Employing the concentric electrical contacts, the electrified tap can orient in any desired direction about the tap stem and maintain the electrical contacts between the lower and upper contact cores.

The electrical current received into the tap handle 22 is embodied in a handle electrical conductor 65. Similar to the tap electrical power connector 35, the handle electrical conductor is most preferably, a two pole electrical connector with a first receiving pole 67, and a second receiving pole 68. The first receiving pole connects to the upper inner contact 52 of the upper contact core 50, and the second receiving pole connects to the upper outer contact 53.

A foremost purpose of the of the present invention is to supply the tap handle 22 of the electrified tap 21 with electrical power. This electrical power, in the form of an electrical current, is preferably utilized for the purpose of illuminating the tap handle, as shown in FIG. 5. This illumination can be achieved through any known form or combination of light emitting electrical devices, including incandescent bulbs, flourescent bulbs, and light-emitting diodes, collectively referred to herein as a powered element 70. Alternatively, the powered element can be any motor, speaker or display that could be utilized within the tap handle. Preferably, the first receiving pole 67, and the second receiving pole 68 connect to the powered element, and so energize the powered element, which is broadly defined herein as whatever electrical device the tap handle houses or serves.

The upper inner contact 32, the lower outer contact 33, the upper inner contact 52, and the upper outer contact 53, can each be referred to herein, simply as a contact 75. Each of the contacts are preferably electrically conductive, metallic materials, such as aluminum copper, zinc or a suitable alloy, as known in the field of electrical connections. Most preferably, copper is employed to form the contacts.

As shown in FIGS. 3 and 6, each contact 75 is preferably formed substantially in the shape of a ring, and each contact includes a contact attachment 76. In the lower contact core 30, the contact attachment receives the first supply pole 37 in the case of the lower inner contact 32, and the second supply pole 38 in the case of the lower outer contact 33. In the upper contact core 50, the contact attachment receives the first receiving pole 67 in the case of the upper inner contact 52, and the second receiving pole 68 in the case of the upper outer contact 53. As is most preferably, the contact attachments are separated below the lower contact face 54 for the lower contact core, and separated above the upper contact face 56 for the upper contact core, to prevent an inadvertent short between contacts.

Preferably, the contact attachment 76 may be a standard crimp connection, as shown in FIGS. 3 and 4, for the lower inner contact 33, and the upper inner contact 52, or a clip connection as shown, for use with the lower outer contact 34 and the upper outer contact 53. Also, as an alternative to the preferred contact attachments, a soldered connection, a screw terminal, or any other electrical junction as is known in the field of electrical wiring technology may be employed with the contacts 75.

In a preferred alternative to the ring-shaped contacts 75 of the present invention, the contacts can be formed with an alternative shape to better provide for the inner electrical contact 57, as formed between the lower inner contact 32 and the upper inner contact 52, and the outer electrical contact 58, as formed between the lower outer contact 33 and the upper outer contact 53. Specifically, as shown in FIGS. 1, 6, and 7, a "wave pattern" 80 can be imparted to the contacts, to better provide for the inner electrical contact and outer electrical contact. The wave pattern insures that the upper inner and lower contacts, as well as the upper outer and lower contacts, will meet with each other solidly, without movement or shifting in position, to provide the needed electrical contacts, and so prevent arcing, sparking or jumping between the respective lower and upper contacts. The wave pattern may be broadly defined as a departure from a purely circular path by the contacts. Either the lower contact core 30 or the upper contact core 50, or as preferred, both the lower contact core and the upper contact core can include the multiple of ribs or a similar feature, serving the purpose of deflecting or deforming the circular path of the contacts.

FIG. 2 shows the lower contact core 30 and the upper contact core 50 meeting, as is accomplished when the ferule 43 is tightened down onto the bushing 23 about the tap stem 26. When viewed in profile, the contacts are approximately flush across the lower contact face 54 of the lower contact core, and the upper contact face 56 of the upper contact core, as also preferably occurs when the herein described wave pattern 80 is utilized.

In a most preferred embodiment of the electrified tap 21, as detailed in FIGS. 8 and 10, the contacts 75 are slightly offset from the lower contact face 54 and the upper contact face 56, in the lateral direction, along the tap stem 26. Specifically, the lower inner contact 32 and the lower outer contact 33 are slightly recessed within the lower contact core 30 relative to the lower contact face. To make the inner electrical contact 57 and the outer electrical contact 58, the upper inner contact 52 and the upper outer contact 53 are slightly raised above the upper contact core 50, relative to the upper contact face. Therefore, the upper contacts extend slightly into the lower contact core, when the upper contact core meets the lower contact core. This lateral offset in the contacts provides for a better connection between the contacts, and also reduces the chance of inadvertent shock when the tap handle 22 is removed from the tap stem, while the lower contacts are electrified. Additionally, with the lower inner contact and the lower outer contact slightly recessed within the lower contact core relative to the lower contact face, any conventional, typically non-powered tap handle, without the upper contact core, is compatible for use with the present invention.

As shown in FIG. 3, a cushion ring 83 is preferably placed between the upper contact core 50 and the ferule 43. The cushion ring serves to maintain pressure between upper contact core and the lower contact core 30, and so maintain the inner electrical contact 57 and outer electrical contact 58. Additionally, the cushion ring allows the tap handle 22 with the features of the present invention, to be used in any conventional non-powered tap in a non-powered mode of operation, without further modification.

To maintain the contacts 75 in the wave pattern 80, and also to better retain the contacts within either the lower contact core 30, or the upper contact core 50, a multiple of ribs 85 are preferably employed, as shown in FIGS. 6 and 7. The multiple of ribs are preferably formed of the same insulative material as the upper and lower contact cores are formed. Most preferably, the contact core are injection molded or milled, as an alternative, with the multiple of ribs included within. The material of the contact cores is preferably a plastic, as selectable by a technician skilled in plastic material selection and fabrication, and most preferably a thermoformable plastic, selected for resistance to melting, and having a high strength.

As an alternative embodiment of the present invention, besides the preferred "two pole" connection, as described herein above, could be employed. Less or more pairs of generally ring shaped contacts 75 could be used. For example, with a single pole electrical connection, the tap stem 26 could be employed as a ground. Safety and shock hazard concerns would likely render this an undesirable alternative. Any multiple of contact "sets," defined herein as upper contact and lower contact pairs, as typified by the upper inner contact 52 and the lower inner contact 32, are considered within the scope of the present invention.

Again, especially with the aid of the wave pattern 80 in the contacts 75 within the electrified tap 21 of the present invention, the inner electrical contact 57 and the outer electrical contact 58 are achieved without regard to the orientation of the upper contact core 50 to the lower contact core 30, as each are received onto and positioned on the tap stem 26, to abut each other with the upper contact face 56 abutted to the lower contact face 54. And so, the electrified tap handle functions safely and reliably, with the quick connecting circuit as described above, regardless of the orientation of the ferule 43 to the bushing 23 about the tap stem.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. An electrified tap comprising:

a bushing receivable onto a locknut, the locknut threadingly receivable onto a tap stem;

a lower contact core receivable within the bushing, the lower contact core having a lower inner contact and a lower outer contact;

an electrical power connection having a first supply pole and a second supply pole, the lower inner contact connectable to a first supply pole of the electrical power connection, and the lower outer contact connectable to a second supply pole of the electrical power connection;

a ferule threadingly receivable onto the tap stem;

an upper contact core receivable within the ferule, the upper contact core having an upper inner contact and an upper outer contact;

a handle electrical connection having a first handle pole and a second handle pole, the upper inner contact connectable to a first handle pole of the handle electrical connection, and the upper outer contact connectable to a second handle pole of the handle electrical connection;

an inner electrical contact between the lower inner contact and the upper inner contact; and an outer electrical contact between the lower outer contact and the upper inner contact, the inner electrical contact and the outer electrical contact achieved without regard to the orientation of the lower contact core with the upper contact core about the tap stem.

2. The electrified tap of claim 1, wherein the bushing and the locknut are combinable into a unitized bushing and locknut.

3. The electrified tap 1 of claim 1, wherein the electrical power connection is a low voltage power supply.

4. The electrified tap of claim 1, wherein the handle electrical connection serves to provide electricity to a powered element in a handle, the handle mounted on the ferrule.

5. The electrified tap of claim 1, wherein the handle electrical connection serves to energize a light emitting powered element in a handle, the handle mounted on the ferrule.

6. The electrified tap of claim 1, wherein the lower contact core includes a multiple of ribs, the lower inner contact and the lower outer contact deformed by the multiple of ribs to depart the lower inner contact and the lower outer contact from a substantially circular path.

7. The electrified tap of claim 1, wherein the upper contact core includes a multiple of ribs, the upper inner contact and the upper outer contact deformed by the multiple of ribs to depart the upper inner contact and the upper outer contact from a purely circular path.

8. The electrified tap of claim 1, wherein the lower contact core includes a multiple of ribs, the lower inner contact and the lower outer contact deformed by the multiple of ribs to depart the lower inner contact and the lower outer contact from a substantially circular path; and the upper contact core includes a multiple of ribs, the upper inner contact and the upper outer contact deformed by the multiple of ribs to depart the upper inner contact and the upper outer contact from a substantially circular path.

9. An electrified tap comprising:

a bushing receivable onto a locknut, the locknut threadingly receivable onto a tap stem;

a lower contact core receivable within the bushing, the lower contact core having a lower contact;

an electrical power connection having a first supply pole and a second supply pole, the lower contact connectable to a supply pole of the electrical power connection;

a ferule threadingly receivable onto the tap stem;

an upper contact core receivable within the ferule, the upper contact core having an upper contact;

a handle electrical connection having a handle pole, the upper inner contact connectable to a handle pole of the handle electrical connection; and an electrical contact between the lower contact and the upper contact, the electrical contact achievable without regard to the orientation of the lower contact core with the upper contact core about the tap stem.

10. The electrified tap of claim 9, wherein the bushing and the locknut are combinable into a unitized bushing and locknut.

11. The electrified tap of claim 9, wherein the electrical power connection is a low voltage power supply.

12. The electrified tap of claim 9, wherein the handle electrical connection serves to provide electricity to a powered element in a handle, the handle mounted on the ferrule.

13. The electrified tap of claim 9, wherein the handle electrical connection serves to energize a light emitting powered element in a handle, the handle mounted on the ferrule.

14. The electrified tap of claim 9, wherein the lower contact core includes a multiple of ribs, the lower inner contact and the lower outer contact deformed by the multiple of ribs to depart the lower contact from a substantially circular path.

15. The electrified tap of claim 9, wherein the upper contact core includes a multiple of ribs, the upper contact deformed by the multiple of ribs to depart the upper contact from a substantially circular path.

16. The electrified tap of claim 9, wherein the lower contact core includes a multiple of ribs, the lower inner contact and the lower outer contact deformed by the multiple of ribs to depart the lower contact from a substantially circular path; and the upper contact core includes a multiple of ribs, the upper inner contact and the upper outer contact deformed by the multiple of ribs to depart the upper contact from a substantially circular path.

* * * * *